US007287742B2

(12) United States Patent
Burns

(10) Patent No.: US 7,287,742 B2
(45) Date of Patent: Oct. 30, 2007

(54) CARBURETOR AND METHOD OF MANUFACTURING

(75) Inventor: Michael P. Burns, Millington, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 268 days.

(21) Appl. No.: 11/027,816

(22) Filed: Dec. 30, 2004

(65) Prior Publication Data

US 2005/0146061 A1 Jul. 7, 2005

Related U.S. Application Data

(63) Continuation-in-part of application No. 10/406,420, filed on Apr. 3, 2003, now abandoned.

(51) Int. Cl.
*F02M 7/14* (2006.01)

(52) U.S. Cl. ..... 261/50.1; 261/50.2; 261/51; 261/DIG. 1

(58) Field of Classification Search ..... 261/50.1, 261/50.2, 51, 58, 60, DIG. 1
See application file for complete search history.

(56) References Cited

U.S. PATENT DOCUMENTS

| | | | | |
|---|---|---|---|---|
| 2,808,245 | A | 10/1957 | Grover | 261/51 |
| 2,986,381 | A | 5/1961 | Jones | 261/41.1 |
| 3,076,639 | A | 2/1963 | Swargulski et al. | 261/34.2 |
| 3,093,698 | A | 6/1963 | Degenhardt | 261/41.1 |
| 3,350,074 | A | 10/1967 | Kalert, Jr. et al. | 261/51 |
| 3,408,054 | A | 10/1968 | Walker | 261/39.3 |
| 3,520,520 | A | 7/1970 | Cheskey | 261/41.1 |
| 3,618,904 | A | 11/1971 | Woods | 261/103 |
| 3,680,846 | A | 8/1972 | Bickhaus et al. | 261/51 |
| 3,906,910 | A | 9/1975 | Szlaga, Jr. | 123/677 |
| 3,953,547 | A | 4/1976 | Schoeman | 261/18.3 |
| 4,481,153 | A | 11/1984 | Kobayashi et al. | 264/44.2 |
| 4,861,522 | A | 8/1989 | Gerhardy et al. | 261/35 |
| 4,936,267 | A | 6/1990 | Gerhardy et al. | 123/179.16 |
| 5,262,092 | A | 11/1993 | Reeder et al. | 261/35 |

(Continued)

FOREIGN PATENT DOCUMENTS

| | | |
|---|---|---|
| JP | 44-6667 | 3/1969 |

(Continued)

*Primary Examiner*—Richard L. Chiesa
(74) *Attorney, Agent, or Firm*—Reising, Ethington, Barnes, Kisselle, P.C.

(57) ABSTRACT

A carburetor has an air intake passage, a fuel passage, a fuel nozzle in communication with the fuel passage and having an opening through which fuel flows, a first valve in communication with the air intake passage and being movable between first and second positions, and a second valve in communication with the fuel nozzle and also being movable between first and second positions to vary the effective flow area of the fuel nozzle. The fuel nozzle is preferably carried by a tube fitted sealably in a bore being in communication with the fuel passage. The opening is defined by the tube and is preferably elongated, extending axially with respect to the tube. A needle of the second valve moves axially within the tube to variably obstruct the opening to control fuel flow. Preferably, a method of manufacturing the tube utilizes a circular cutting tool which plunges into the tube cutting a slit as the opening having a sharp peripheral edge for atomizing the fuel.

39 Claims, 7 Drawing Sheets

U.S. PATENT DOCUMENTS

| | | | | |
|---|---|---|---|---|
| 5,411,680 | A | 5/1995 | McCarthy et al. | 261/35 |
| 5,537,979 | A | 7/1996 | Nuti | 123/438 |
| 5,554,322 | A | 9/1996 | Kobayashi | 261/35 |
| 6,059,271 | A | 5/2000 | Gerhardy | 261/35 |
| 6,283,460 | B1 * | 9/2001 | Omarsson | 261/50.1 |
| 6,631,889 | B2 | 10/2003 | Nonaka | 261/35 |

FOREIGN PATENT DOCUMENTS

| | | |
|---|---|---|
| JP | 2002-266705 | 9/2002 |
| JP | 2002-276470 | 9/2002 |
| JP | 2002-285911 | 10/2002 |
| JP | 2003-020996 | 1/2003 |

* cited by examiner

CARBURETOR AND METHOD OF MANUFACTURING

REFERENCE TO RELATED APPLICATION

This is a continuation-in-part of U.S. patent application Ser. No. 10/406,420, filed Apr. 3, 2003, and now abandoned in favor of this patent application.

FIELD OF THE INVENTION

This invention relates generally to fuel delivery systems and more particularly to a carburetor.

BACKGROUND OF THE INVENTION

Carburetors have been used to produce and control the delivery of a fuel and air mixture to an internal combustion engine. Some carburetors have a main body with an air intake passage extending therethrough and a throttle valve disposed in the air intake passage. The throttle valve is movable between an idle position and a wide open throttle position to control the flow of air through the carburetor.

In so-called butterfly-type carburetors, the throttle valve comprises a generally flat disk rotatable in the intake passage to vary the effective flow area of the air intake passage. Rotation of the throttle valve permits a vacuum pressure signal to act as a function of the position of the throttle valve on a plurality of fuel jets opening into the air intake passage. Thus, movement of the throttle valve controls the flow of fuel out of the various fuel jets whereupon the fuel is mixed with air flowing through the air intake passage. The fuel and air are mixed in the air intake passage and subsequently delivered to an engine to support its operation.

In so-called rotary throttle-type carburetors, a valve chamber extends perpendicular to the air intake passage and a cylindrical throttle valve shaft is received in the valve chamber. A hole through the throttle valve shaft is increasingly aligned with the air intake passage as the throttle valve is rotated from its idle position towards its wide open throttle position to control air flow in the carburetor. A needle carried by the throttle valve shaft is moved relative to a fuel nozzle as the throttle valve is rotated, to vary the effective flow area of the fuel nozzle. In this manner, the flow rate of fuel is adjusted according to the position of the throttle valve, and fuel discharged from the fuel nozzle mixes with air in the air intake passage for delivery of a fuel and air mixture to the engine.

SUMMARY OF THE INVENTION

A carburetor has an air intake passage, a fuel passage, a first valve in communication with the air intake passage and being movable between first and second positions, a second valve in communication with the fuel passage to vary the flow rate of fuel discharged from the fuel passage, and an actuator associated with the first and second valves to cause movement of one of them in response to movement of the other. So constructed and arranged, the first valve controls at least in part the air flow through the carburetor and the second valve controls at least in part the fuel flow from the carburetor.

Preferably, the actuator has a cam assembly associated with both the first and second valves which drives the second valve in response to movement of the first valve. In one form, the second valve has a needle that moves relative to a fuel nozzle opening to vary its effective flow area. In this form, the cam assembly retracts and advances the needle relative to the fuel nozzle in response to movement of the first valve. Preferably, the fuel nozzle opening is manufactured or cut into a substantially cylindrical tube, and is elongated in an axial direction with respect to the tube. A leading open end of the tube is then inserted and press fitted into a bore of the body. Once assembled, the open end is in communication with the fuel passage and the fuel nozzle opening. Insertion of the needle of the second valve into the tube controllably obstructs the fuel nozzle opening and thus controls the fuel flow through the open end of the tube.

In one form, the fuel nozzle opening communicates with the air intake passage so that a fuel and air mixture is discharged from the air intake passage for delivery to the engine. In a second form, the fuel nozzle opening communicates with a second air passage such that air is discharged from the air intake passage and a fuel and air mixture is discharged from the second air passage for delivery to the engine. Preferably, a method of manufacturing the tube of the fuel nozzle utilizes a circular rotating cutting tool which cuts the elongated slit into the tube while producing a sharp peripheral edge that atomizes fuel flowing through the opening. Of course, other forms or embodiments of the invention will be apparent to those skilled in the art.

Some of the objects, features and advantages of the invention include providing a carburetor that delivers all of the fuel for delivery to the engine through a single nozzle, has improved idle, rollout, acceleration and come down performance, has improved all position rollout, enables use of an air intake passage without a venturi throat, is readily adjustable, can be used with a fuel passage having a fixed or adjustable orifice, is of relatively simple design and economical manufacture and assembly and has a long useful life in service. Of course, other objects, features or advantages may be realized from the various possible embodiments of the invention, and some embodiments may realize fewer or more than the above listed objects, features and advantages.

BRIEF DESCRIPTION OF THE DRAWINGS

These and other objects, features and advantages of the present invention will be apparent from the following detailed description of the preferred embodiments, appended claims and accompanying drawings in which:

DETAILED DESCRIPTION OF THE PREFERRED EMBODIMENTS

Figure 2:
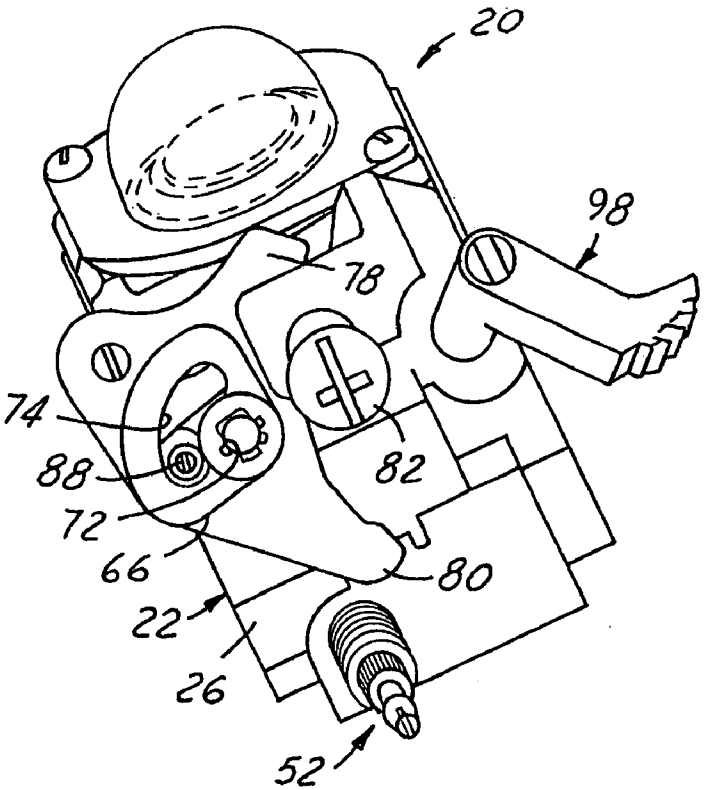
FIG. 2 is a perspective view of the carburetor of FIG. 1.

Referring in more detail to the drawings, FIGS. 1-9 illustrate a first embodiment of a carburetor 20 that has a body 22, an air intake passage 24 formed in a main block 26 of the body, a first valve 28 associated with the air intake passage 24, a fuel passage 30 having a fuel nozzle 32, and a second valve 34 associated with the fuel nozzle 32. The first valve 28 is movable between first and second positions to control air flow through the air intake passage 24 and corresponds to idle and wide open throttle engine operation, respectively. The second valve 34 is preferably moved between first and second positions by an actuator in response to movement of the first valve 28 to vary the effective flow area of the fuel nozzle 32 and thereby control the flow rate of fuel discharged from the carburetor. Of course, the second valve 34 could be driven between its first and second positions with the first valve 28 responsive to such movement of the second valve 34 to cause the first valve 28 to rotate between its first and second positions.

In the embodiment shown, the carburetor 20 is a diaphragm-type carburetor that may utilize a conventional fuel circuit to receive fuel via a diaphragm-type fuel pump assembly and thereafter delivers fuel to a fuel metering assembly defined in part by a fuel metering diaphragm 40 received between the main block 26 and an end plate 42 of the carburetor body 22. The fuel metering assembly and the fuel pump assembly of the carburetor 20 may be constructed as shown and described in U.S. Pat. No. 5,262,092, the disclosure of which is incorporated herein by reference in its entirety. In general, on one side, the diaphragm 40 defines in part a fuel metering chamber 43 (FIG. 4) and on its other side an atmospheric reference chamber (not shown). An inlet valve controls the flow of fuel from the fuel pump into the metering chamber 43, and is actuated by movement of the fuel metering diaphragm 40.

Figure 1:
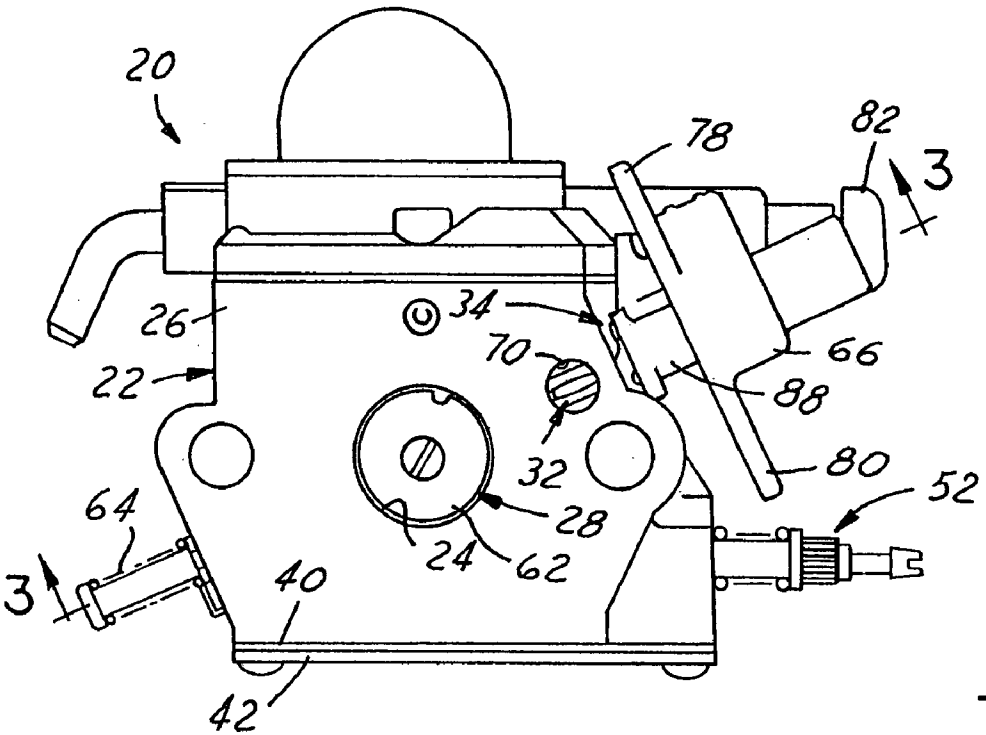
FIG. 1 is a side view of a carburetor according to a first embodiment of the invention.
Figure 3:
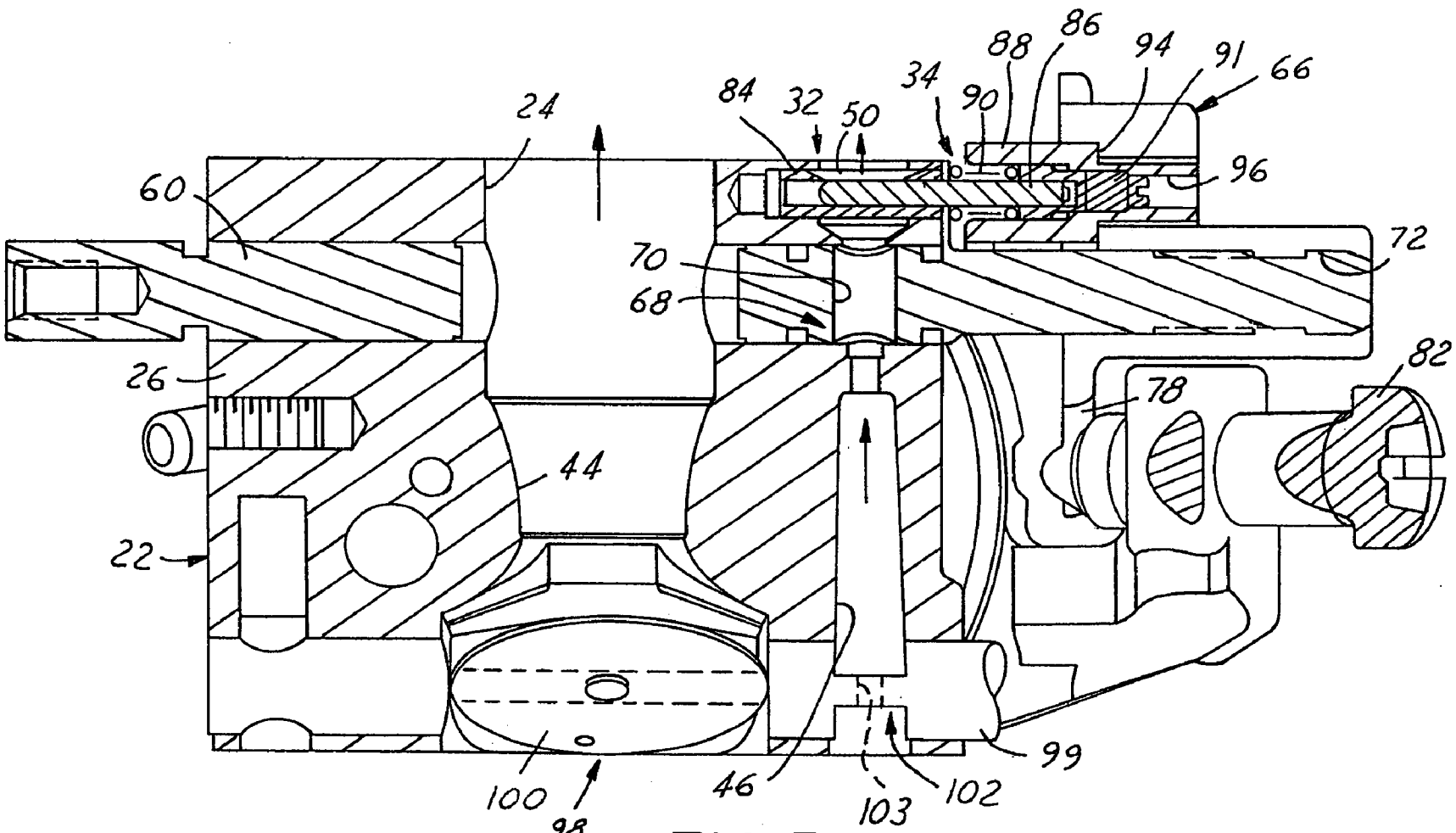
FIG. 3 is a sectional view of the carburetor taken generally along line 3-3 in FIG. 1.
Figure 4:
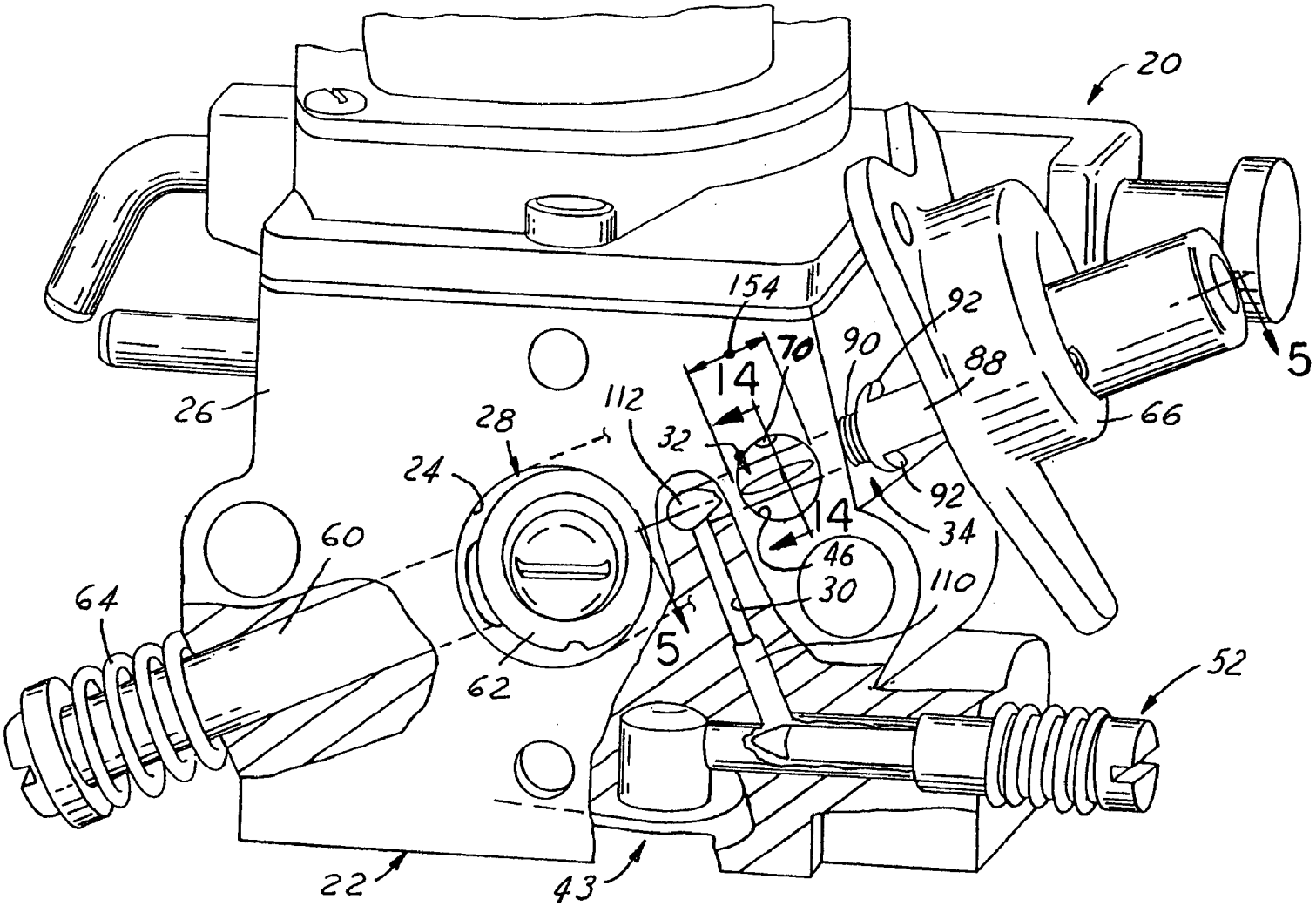
FIG. 4 is a perspective view of the carburetor of FIG. 1 with a portion broken away and in section.

As shown in FIG. 1, the air intake passage 24 extends through a main block 26 of the carburetor body 22 to permit air flow through the carburetor. The air intake passage 24 may have a venturi portion 44 (FIG. 3) providing a reduced diameter throat as is known in the art, or in the alternative, may be a straight cylindrical passage. A second air passage 46 is formed though the carburetor body 22, preferably in the main block 26 parallel to and separate from the air intake passage 24. As shown in FIG. 4, the fuel passage 30 is also formed in the carburetor body 22, preferably, at least in part in the main block 26. The fuel passage 30 communicates at one end with the fuel metering chamber 43 which contains a pool of fuel. At its other end, the fuel passage 30 communicates with the fuel nozzle 32 that is preferably carried by the carburetor body 22 and has an opening 50 through which fuel is discharged for subsequent delivery to an operating engine. Preferably, an adjustment screw 52 is carried by the carburetor body 22, and is preferably threaded in the main block 26 so that an end of the adjustment screw 52 can be moved relative to the fuel passage 30 to control the flow rate of fuel through the fuel passage 30. The fuel passage 30 may also be controlled with a fixed orifice upstream of the nozzle 32 or may not have any orifice or adjustment screw 52 at all.

In the embodiment shown, the fuel nozzle opening 50 is open to the second air passage 46 so that in operation, a fuel and air mixture is delivered from the second air passage 46. Preferably, the nozzle 32 is disposed adjacent to an end of the second air passage 46 adjacent to the engine to increase the vacuum signal at the nozzle during operation of the engine and improve fuel flow through the fuel passage 30 and out of the fuel nozzle 32.

The first valve 28 is associated with the air intake passage 24 and has a valve shaft 60 extending through the main block 26 and the air intake passage 24. The shaft 60 is carried by the carburetor body 22 for rotation between first and second positions corresponding to an idle and wide open throttle engine operating conditions. A valve head 62 is carried by the valve shaft 60 and is preferably a flat disk rotatably received in the air intake passage 24. At idle, the valve head 62 is disposed substantially perpendicular to the air intake passage 24 and permits only a relatively low flow rate of air therethrough. At wide open throttle, the valve head 62 or disk is rotated so that it is generally parallel to the air flow through the intake passage 24 and permits a substantially free flow of air therethrough. A spring 64 on an end of the shaft 60 biases the first valve 28 towards its first position corresponding to idle engine operation. A valve lever 66 is disposed on the other end of the first valve shaft 60 and may be connected to a throttle cable so that the first valve 28 is rotated in response to desired engine performance between idle and wide open throttle. In FIG. 3, the valve shaft 60 is shown without the valve head 62.

As best shown in FIG. 3, the valve shaft 60 has a second valve portion 68 associated with the second air passage 46. The second valve portion 68 has a through bore 70 that is increasingly aligned or registered with the second air passage 46 as the first valve 28 is rotated from its first position toward its second position. When the first valve 28 is in its first position, the second valve portion 68 preferably at least substantially closes the second air passage 46, and when the first valve 28 is in its second position, the second valve portion 68 preferably permits a substantially unrestricted flow therethrough. In this manner, the flow rate of air through the second air passage 46 can be controlled.

Figure 5:
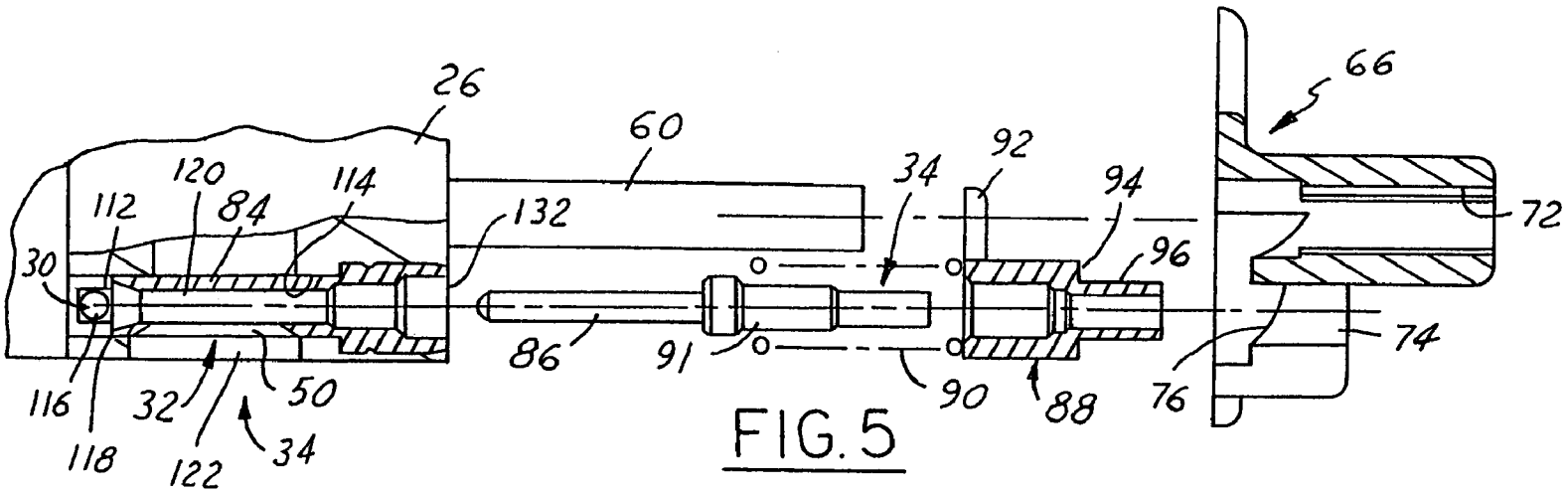
FIG. 5 is an exploded, fragmentary sectional view taken generally along line 5-5 of FIG. 4.
Figure 8:
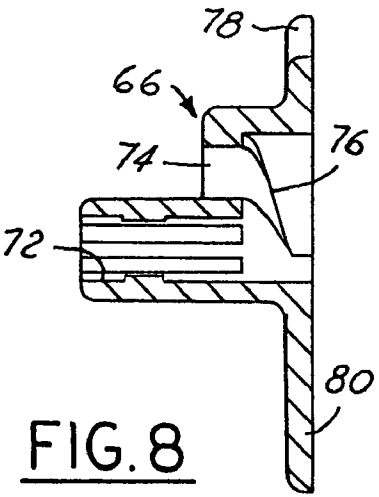
FIG. 8 is a sectional view taken generally along the line 8-8 in FIG. 7.
Figure 7:
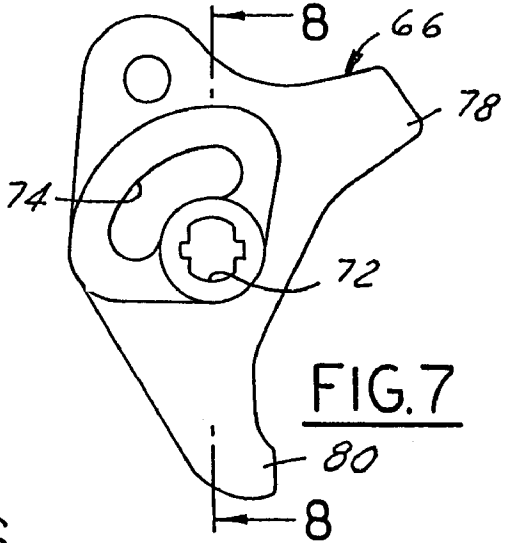
FIG. 7 is a plan view of a valve lever of the carburetor of FIG. 1.

As best shown in FIGS. 5, 7 and 8, the valve lever 66 has a bore 72 in which the valve shaft 60 is received, an arcuate slot 74 preferably separate from the bore 72, and an inclined cam surface 76 adjacent to the slot 74. The valve lever 66 also has a pair of outwardly extending flanges 78, 80. One flange 78 is positioned to engage an idle adjustment screw 82 to locate the first valve 28 in its first position, and the other flange 80 is constructed to engage a projection or other stop on the carburetor body 22 to locate the first valve 28 in its second position corresponding to wide open throttle engine operation.

As best shown in FIGS. 1, 3-5 and 11-14, the second valve 34 is associated with the fuel nozzle 32 and is movable between first and second positions which control the effective flow area of the opening 50 of the fuel nozzle 32. In this manner, the flow rate of fuel out of the fuel nozzle 32 can be controlled, at least in part. In the embodiment shown, the opening 50 of the fuel nozzle 32 is formed by a slit in a substantially cylindrical tube 84 carried by the body 22 that defines in part the fuel passage 30. The second valve 34 has a needle or obstructing valve member 86 disposed at least in part in that tube 84 covering at least a portion of the fuel nozzle opening 50 when the second valve 34 is in its first position. The needle 86 is carried by a follower 88 that is yieldably biased by a spring 90 into engagement with the cam surface 76 of the valve lever 66. Desirably, the needle 86 may be threadedly received in the follower 88 to permit axial adjustment of the needle 86 within the fuel passage 30 and relative to the fuel nozzle 32. As shown in FIGS. 3 and 5, the needle 86 may be received in a carrier 91 threadedly carried by the follower 88 for axial adjustment of the needle 86. Of course, the needle 86 may be associated with the follower 88 in other ways with or without any carrier, including being press fit, welded, adhered or may be integrally formed with the follower, as examples.

Figure 9:
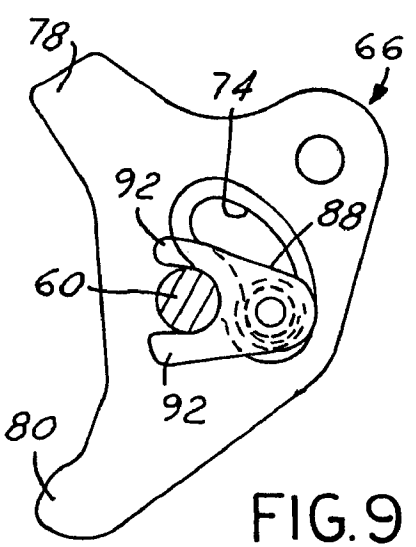
FIG. 9 is a plan view of a cam assembly of the carburetor of FIG. 1.
Figure 6:
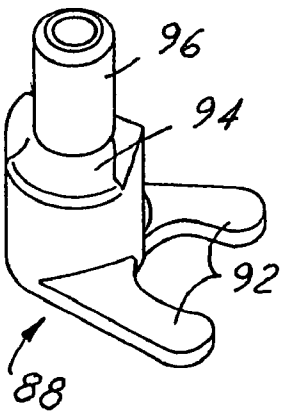
FIG. 6 is a perspective view of a follower used in the carburetor of FIG. 1.

As best shown in FIGS. 6 and 9, the follower 88 preferably has a pair of fingers 92 which straddle the first valve shaft 60 to guide the follower 88 for axial movement parallel to the first valve shaft 60. Preferably, the follower 88 has a radially extending shoulder 94 which engages the cam surface 76, and a cylindrical stem 96 which is received at least partially in the slot 74 formed in the first valve lever 66. An actuator is defined at least in part by the cam assembly which includes, at least in part, the cam surface 76 and follower 88.

Accordingly, when the first valve 28 and its valve lever 66 are rotated in response to a desired change in engine operating conditions, the cam surface 76 is moved relative to the follower which is maintained in engagement with the cam surface 76 by the spring 90. Movement of the inclined cam surface 76 permits axial movement of the follower 88 and hence, the needle 86. This axial movement of the needle 86 changes its position relative to the fuel nozzle opening 50 to alter the effective flow area of the fuel nozzle 32.

When the first valve 28 is rotated from its first position towards its second position, the needle 86 is retracted relative to the fuel nozzle opening 50 to increase its effective flow area and permit increased fuel flow therethrough. At the same time, the bore 70 in the first valve shaft 60 becomes increasing aligned or registered with the second air passage 46 to permit increased airflow therethrough (designated by arrows 85 in FIG. 14) which is mixed with the atomized fuel (designated by arrow 87 in FIG. 14) exiting the fuel nozzle 32 and subsequently delivered to the engine. Also at that same time, the first valve head 62 is rotated relative to the air intake passage 24 to permit an increased air flow therethrough. The fuel and air mixture discharged from the second air passage 46 may be mixed with the air discharged from the air intake passage 24 prior to or after being delivered to the engine. As the first valve 28 is rotated towards its first position, the needle 86 is advanced relative to the opening 50 of the fuel nozzle 32 to decrease its effective flow area and the fuel flow rate therethrough. At the same time, the first valve shaft 60 increasingly restricts the airflow through the second air passage 46, and the valve head 62 increasingly restricts air flow through the air intake passage 24.

As generally shown in FIGS. 2 and 3, a choke valve 98 may also be utilized with this carburetor 20. The choke valve 98 preferably has a shaft 99, a generally flat first choke valve head 100 on the shaft 99 and disposed in the air intake passage 24, and a second choke valve head 102 disposed in the second air passage 46. As shown in this embodiment, the first choke valve head 100 is a flat, generally circular disk and the second choke valve head 102 is integral with the shaft 99 with a bore 103 in variable alignment or registry with the second air passage 46. When closed, both the first and second valve heads 100, 102 preferably substantially restrict air flow through the air intake passage 24 and the second air passage 46, respectively. When wide open, both the first choke valve head 100 and second choke valve head 102 preferably permit a substantially unrestricted airflow through the air intake passage 24 and the second air passage 46, respectively. The choke valve 98 may have intermediate positions between its closed and fully opened positions as is known in the art.

More specific to the second or fuel valve 34, fuel flowing through a body portion 110 of the fuel passage 30 enters a bottom region 112 of a blind bore 114 formed into the body 26 and through a port 116 defined by the body 26, as best shown in FIGS. 4-5. From the bottom region 112, fuel flows through a first or leading open end 118 of the tube 84 and thus into a tube portion 120 of the fuel passage 30 defined by the tube. From the tube portion 120, fuel is atomized by machined characteristics of the slit 50 and flows out of the tube 84 via that portion of the opening or slit 50 not obstructed by the needle 86 and into a mixing region or outlet port 122 of the second air passage 46 where it then preferably enters the crankcase of a scavenging two-stroke combustion engine.

The tube 84 has an outer surface 124 which is slightly tapered, or generally transitions down in diameter, such that it is generally resembles a frustum shaped. The first or leading open end 118 of the tube 84 thus has a slightly smaller outer diameter 126 than an outer diameter 128 of an opposite or trailing open end 130 of the tube 84 through which the needle 86 extends, as best shown in FIGS. 3 and 11-14. During assembly, the elongated tube 84 is press fit into the elongated, generally blind, bore 114 of the body 26 which traverses or communicates substantially perpendicularly through the second air passage 46. The bore 114 extends longitudinally slightly beyond the air passage 46 placing the bottom portion or blind end 112 diametrically opposite to an opening or entry 132 of the bore and as viewed with respect to the air passage 46, as best shown in FIG. 5.

To achieve a sealing press fit between the ends of the tube 84 and the body 26, the diameter of the bore 114 at the blind end 112 generally conforms to and is slightly less than the diameter 126 of the tube 84 at the leading end 118, and the diameter of the bore 114 at the opening 132 generally conforms to and is slightly less than the diameter 128 of the tube 84 at the trailing end 130. Consequently, when the tube 84 is completely inserted in the body 26, the taper of the bore 114 and the corresponding taper of the tube 84 preferably form a compression fit at both ends 118, 130 of the tube 84 with the body 26. Preferably, the tube 84 is made of brass and the carburetor body is made of cast aluminum. However, other fuel resistant materials known in the art may also be applied to achieve the same compression fit. For instance, the tube 84 can be made of injection molded plastic with brass compression rings added at each end and located radially between the body 26 and the tube 84 (not shown).

As best illustrated in FIGS. 11-13 and 15-16, the tube 84 includes an annular cylindrical wall 134 having the outer surface 124 carrying a continuous outer edge 140, an inner cylindrical surface 136 carrying a continuous inner edge 138, and the opening or slit 50 formed in the wall 134 having a flow cross section which is generally defined by the inner and outer edges 138, 140 and increases in the radially outward direction. The inner cylindrical surface 136 defines the tube portion 120 of the fuel passage 30 and the outer surface 124 is substantially exposed in the air passage 46 with the opening or slit 50 directed downstream and facing the mixing region 122, as best shown in FIG. 14.

Figure 11:
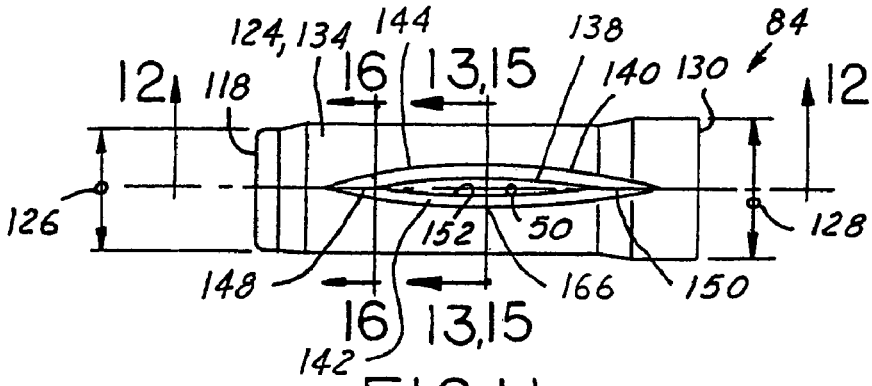
FIG. 11 is a side view of a tube of a second valve of the carburetor.
Figure 12:
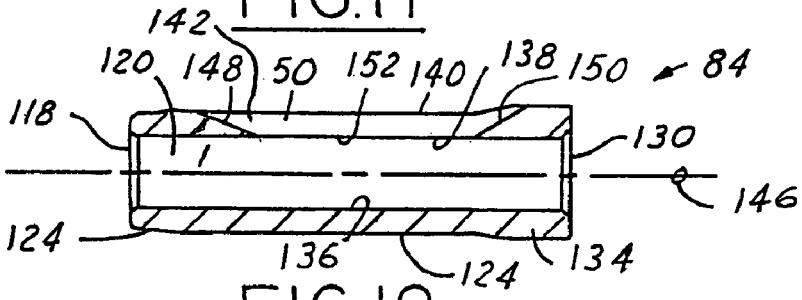
FIG. 12 is a cross section of the tube taken along line 12-12 of FIG. 11.

The opening or slit 50 is defined by two concave opposing faces 142, 144 which are elongated axially with respect to a center axis 146 of the tube 84 and meet at respective ends 148, 150 which generally form a valley sloping radially inward from the outer edge 140 and to the inner edge 138, as best shown in FIG. 11. The faces 142, 144 span laterally radially outward from the inner edge 138 to the outer edge 140, generally diverging away from one another in the radial outward direction.

Figure 13:
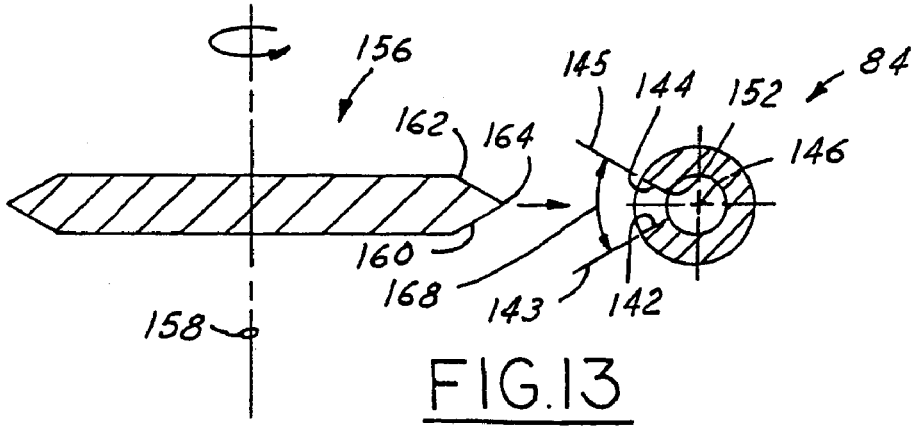
FIG. 13 is a cross section of the tube taken along line 13-13 of FIG. 11 and being orientated with a cutting tool.
Figure 14:
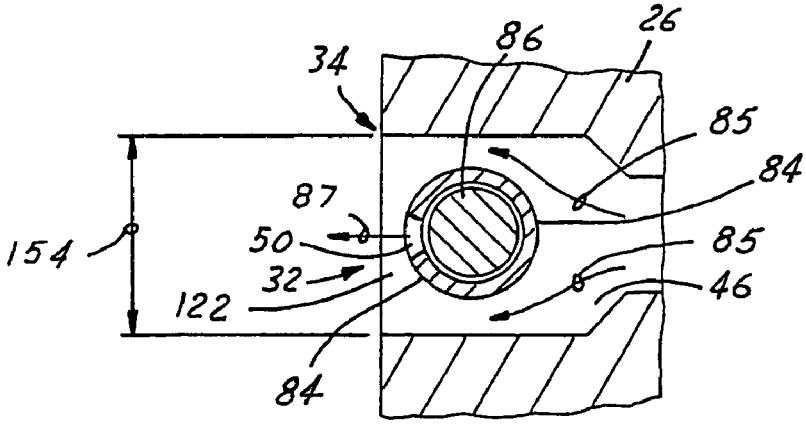
FIG. 14 is a cross section of the second valve taken along line 14-14 of FIG. 4.
Figure 15:
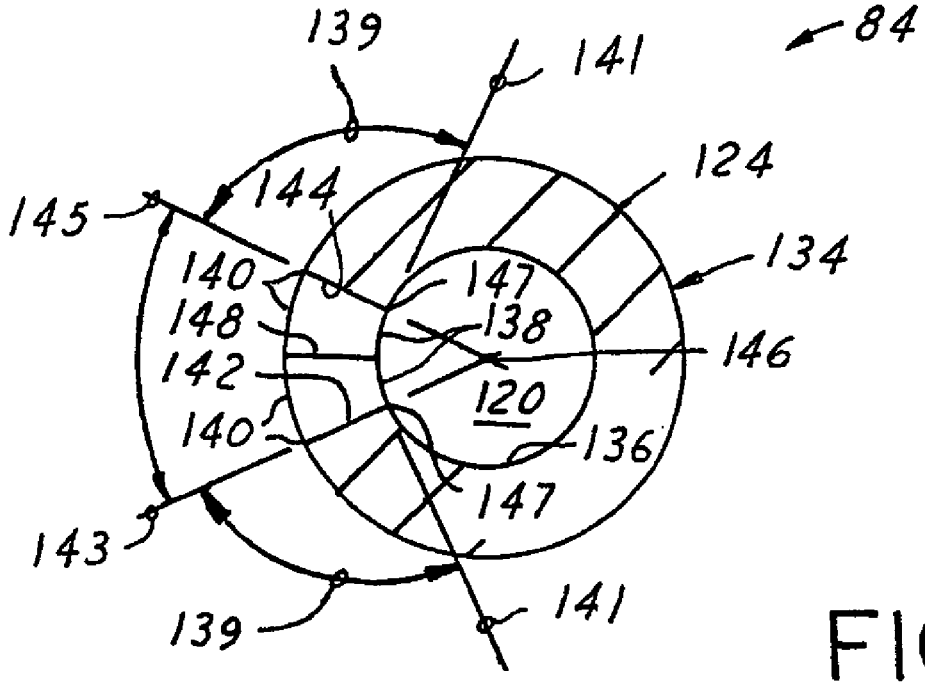
FIG. 15 is an enlargement of the tube of FIG. 13.
Figure 16:
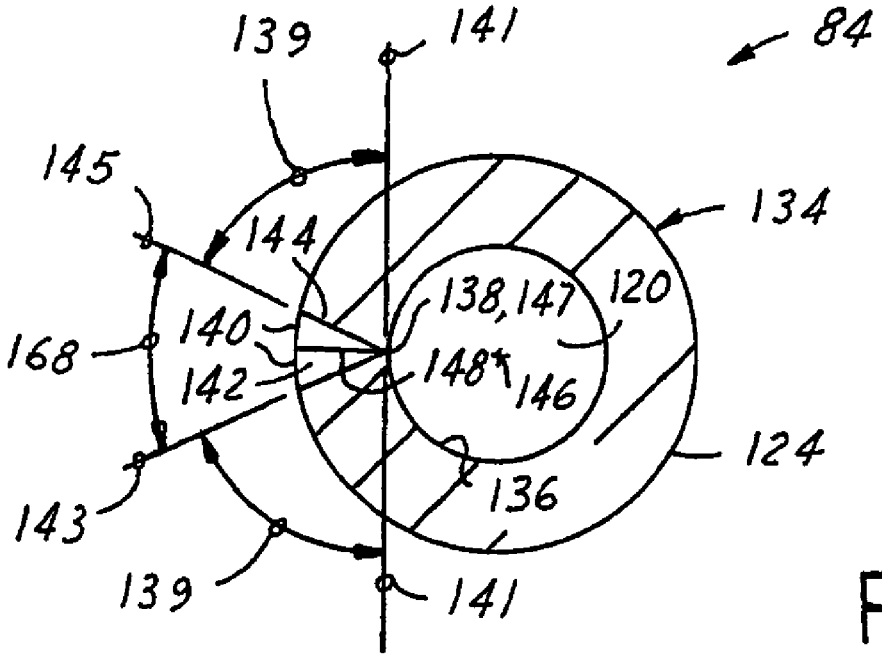
FIG. 16 is a cross section of the tube taken along line 16-16 of FIG. 11.

When viewing a lateral cross section of the tube 84 through the center of the slit 50 which lies within a first imaginary plane disposed perpendicular to the center axis 146 (as best shown in FIGS. 13 and 15), the inner edge 138 is generally sharp and formed by the congruent convergence at an acute angle 139 of the machined faces 142, 144 with the inner cylindrical surface 136. The acute angle 139 is about ninety degrees and is measured through the tube wall 134 between an imaginary tangential line 141 and an imaginary cutting line 143 or 145 which intersect one-another at a point 147 of the inner edge 138 that intersects the first imaginary plane. The tangential line 141 lies in the first imaginary plane and is disposed tangentially to the inner surface 136 at point 147. When the imaginary cutting lines 143 and 145 are viewed lying in the first imaginary plane, they intersect one-another at about the center axis 146 and lie on the respective faces 142, 144.

From about ninety degrees at the mid point 166 or first imaginary plane, the acute angle 139 generally preferably decreases with the decreasing width of the slit 50. For illustration purposes and referring to FIG. 16, the acute angle 139 measured in a second imaginary plane spaced axially away from the first imaginary plane, is about sixty-five degrees. The location of the second imaginary plane is taken through the point 147 where the ends or valleys 148, 150 meet the inner edge 138. Contrary to the first imaginary plane, the intersection of the cutting lines 143, 145 do not intersect at the center line 146, but instead intersect at about the point 147. The tangential line 141 when lying on the second imaginary plane, also intersects point 147.

The sharp continuous edge 138 facilitates atomizing the fuel flowing through the flow cross section generally defined by the edge 138 from the tube portion 120 and through the opening or slit 50. The opposing faces 142, 144 diverge away from one-another in a radial outward direction (i.e. the flow cross section at the outer edge 140 is larger than the flow cross section at the sharp inner edge 138) to prevent excessive fuel wetting of the faces 142, 144. The diverging faces 142, 144 combined with the fuel atomizing characteristic of the sharp inner edge 138 reduce or prevent fuel from collecting or gathering at the nozzle thus it enhances the desired mixing of fuel and air in the mixing region 122.

The length of the opening or slit 50 is preferably slightly less than an opening size or diameter 154 of the fuel-and-air mixing region 122 of the air passage 46 carried by the carburetor body 26, as best shown in FIG. 14. Maximizing the length of the slit 50 provides a highly sensitive fuel nozzle 32 of the second valve 34 when used in conjunction with the needle 86 by increasing the axial graduation and effective flow area or flow cross section through the slit 50. Furthermore, and as previously described, the slit 50 converges upon itself toward the ends 148, 150. This convergences, or decrease in slit width at the ends 148, 150 provides greater control over fuel metering and fuel-and-air mixing when needed at low engine rpm's and idle.

During manufacturing, preferably the opening or slit 50 of the tube 84 is cut into the tube 84 by a plunging, rotating circular cutting tool 156, which is preferably a dado blade, grinder or router bit, having a rotational axis 158 which is substantially perpendicular to the center axis 146 of the tube 84 (as best shown in FIG. 13). The circular cutting tool 156 has two circular cutting surfaces 160, 162 which converge to a circular cutting point 164. The cutting point 164 of the rotating cutting tool 156 leads the cutting or grinding action of the tool as it plunges into the preferably brass material of the wall 134 of the tube 84. The cutting surfaces 160, 162 produce the respective concave faces 142, 144, and the curvature of the circular tool 156 in-effect produces the converging ends 148, 150 and opposite valleys of the slit 50 upon machining completion.

As previously described, the cross section profile of the faces 142, 144 taken at the mid point 166 of the slit 50 preferably lie along respective imaginary cutting lines 143, 145 that intersect one-another at about the center axis 146. Hence, when the blade 156 plunges into the tube 84, the cutting point 164 preferably does not plunge further than about the center axis 146 at the slit mid-point 166. The length of the slit 50 is generally dictated by the diameter of the rotating cutting tool 156. That is, the more gradual the peripheral curvature of the tool, the longer will be the slit 50 when achieving a consistent cutting depth. The circumferential angle 168 between the two imaginary cutting lines 143, 145 of the faces 142, 144 at the mid-point 166 and as designated by arrow 168 preferably lies within a range of thirty-five to sixty-five degrees and is preferably about fifty-five degrees. A desired angle 168 for a given application can be empirically determined and depends upon many parameters including fuel and air flow characteristics, fuel pressure, and the thickness of wall 134. In one presently preferred embodiment, the lower limit of the angle 168 is chosen to limit or prevent fuel wetting on the faces 142, 144 which might in some applications degrade the desired fuel mixing with air, and the upper limit of the angle 168 is chosen to prevent weakening the structural integrity of the tube 84 and needlessly complicating machining of the opening or slit 50.

Figure 10:
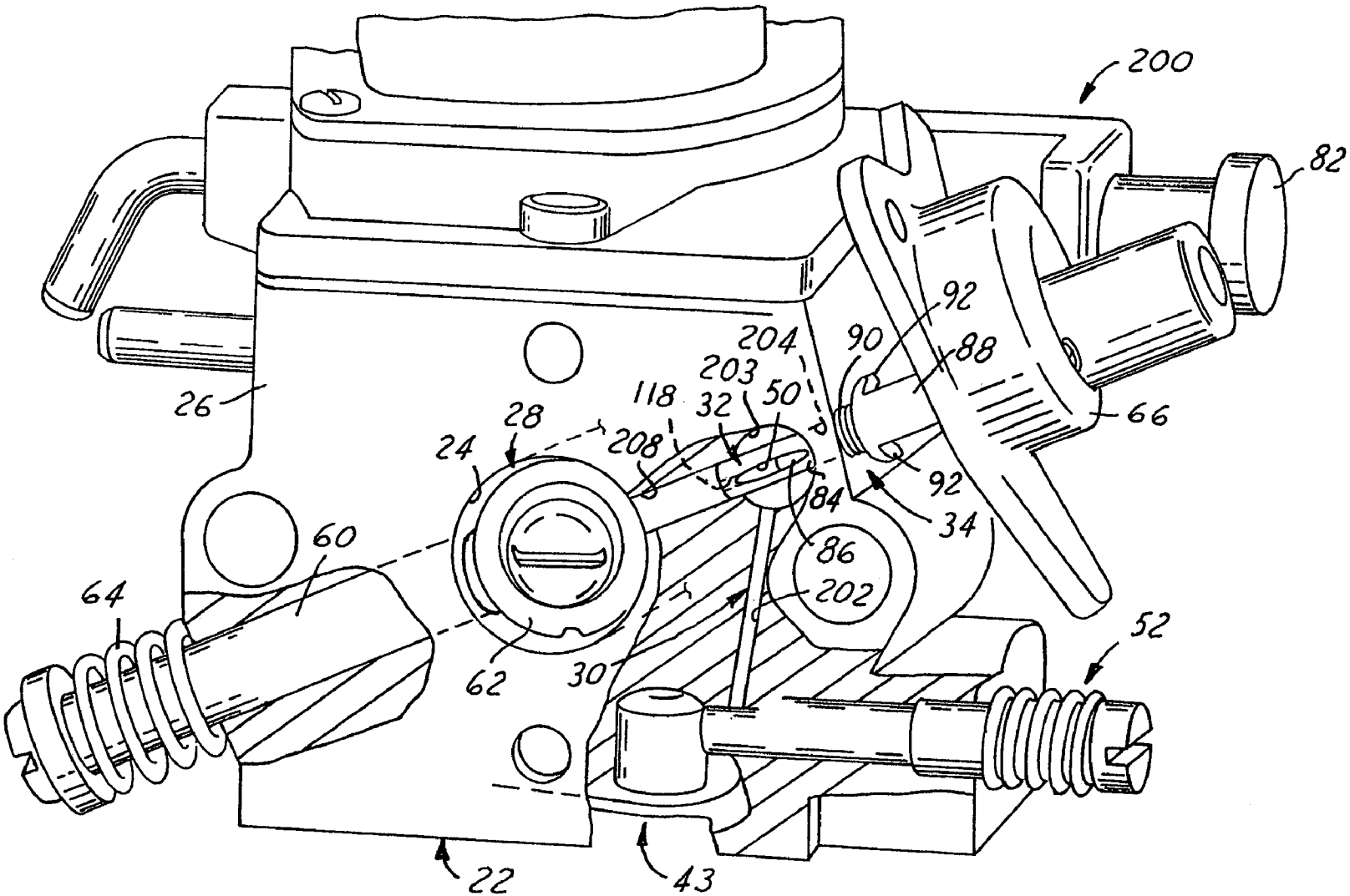
FIG. 10 is a side view with portions broken away and in section of a carburetor according to a second embodiment of the invention.

A carburetor 200 according to a second embodiment of the present invention is shown in FIG. 10. As shown, the second embodiment carburetor 200 may be very similar to the first embodiment carburetor 20, and hence the same reference numbers are used to denote similar parts between the embodiments. However, and as illustrated, fuel flow through the tube portion 120 of the fuel passage 30 is preferably reversed with the fuel entering the tube portion 120 through the slit 50 and exiting the tube portion 120 through the open end 118 of the tube 84.

As shown in FIG. 10, the second embodiment carburetor 200 does not have a second air passage 46 therethrough. In this embodiment carburetor 200, the fuel passage 30 communicates at one end with a supply of fuel, such as that in a fuel metering chamber 43, and at its other end opens into the air intake passage 24, preferably downstream of the first valve head 62. The fuel passage 30 includes a first portion 202 that communicates at one end with the supply of fuel and at its other end with a bore 203 open to a bore 204 in which the fuel nozzle 32 and tube is received. The fuel nozzle 32 has the second opening or open end 118 at one end that communicates with the opening 50 of the fuel nozzle 32. The second opening 118 also communicates with a second portion 208 of the fuel passage defined by the bore 204 downstream of the fuel nozzle 32.

Therefore, fuel from a fuel supply (such as a fuel metering chamber) flows through the first portion 202 of the fuel passage 30, the bore 203, into the opening 50 of the fuel nozzle, out of the second opening 118 of the fuel nozzle 32 and through the second portion 208 of the fuel passage 30 that opens into the air intake passage 24. Fuel flow is regulated or controlled by at least the needle 86 of the second valve 34 that is slidably received in the tube 84 to vary the effective open area of the opening 50 in the tube 84 of the fuel nozzle 32. The fuel nozzle 32 and second valve 43 may be constructed as set forth in the previous embodiment carburetor 20. The second valve 34 may have the needle 86, follower 88 with fingers 92, spring 90, and stem 96 (not shown in FIG. 10), and the carburetor 20 may have first valve lever 66, and other features as previously described. Accordingly, movement of the first valve 28 is transmitted to the needle 86 via an actuator in a similar manner as in the carburetor 20. Accordingly, in this embodiment, all of the air and fuel is discharged from the carburetor out of the air intake passage 24 for delivery to the engine. Fuel is induced to flow through the flow path described above and into the air intake passage 24 by the vacuum signal provided by the operating engine.

Persons of ordinary skill in the art will recognize that the preceding description of the preferred embodiments of the present invention is illustrative of the present invention and not limiting. Alterations and modifications may be made to the various elements of the carburetor without departing from the spirit and scope of the present invention. For example, and without limitation, while it has been disclosed in the embodiment shown that the second valve is responsive to movement of the first valve, the first valve could be responsive to movement of the second valve. Also, the first and second valves could be constructed differently and may be oriented and arranged in a manner different from that shown in the representative embodiments disclosed. The wall 134 or a portion thereof can be planar 95 instead of tubular and still carry the flared opening 50. Still other modifications are possible within the spirit and scope of the present invention.

What is claimed is:

1. A carburetor that provides a fuel and air mixture to an engine, comprising:

a body having an air intake passage and a fuel passage in communication with a fuel source;

a first valve having a valve shaft and a valve head disposed in communication with the air intake passage and movable between a first position corresponding to idle engine operation and a second position corresponding to wide open throttle engine operation;

a tube having a wall with a first opening through the wall and a second opening axially spaced from the first opening and communicating with the fuel passage for fuel flow through the tube and the openings, the first opening being elongated axially relative to the tube and having an axially elongated and concave first face extending between inner and outer edges of the wall of the tube, an opposed axially elongated and concave second face extending between inner and outer edges of the wall of the tube, and the flow area of the first opening defined at least in part by the concave faces increases in a radially outward direction;

a second valve disposed in communication with the fuel passage and movable between first and second positions to vary the flow rate of fuel through the first opening of the tube, whereby the first valve controls at least in part the air flow out of the carburetor and the second valve controls at least in part the fuel flow out of the carburetor; and an actuator associated with the first valve and the second valve to cause movement of one of the first valve and second valve in response to movement of the other of the first valve and second valve.

2. The carburetor of claim 1 wherein the first opening communicates with the air intake passage so that fuel that flows through the first opening enters the air intake passage.

3. The carburetor of claim 2 wherein the first opening of the tube communicates with the air intake passage downstream of the first valve.

4. The carburetor of claim 1 wherein the actuator has a cam assembly operably associated with the first valve and the second valve to drive the second valve between its first and second positions in response to movement of the first valve between its first and second positions.

5. The carburetor of claim 4 wherein the cam assembly has a cam surface associated with the first valve and a follower associated with the second valve so that the follower is displaced by the cam surface as the first valve moves.

6. The carburetor of claim 5 wherein the second valve has a needle disposed adjacent to the first opening of the tube and carried by the follower for movement relative to the first opening to vary the effective flow area of the first opening.

7. The carburetor of claim 6 wherein the needle extends axially in at least a portion of the tube and is axially moved by the cam assembly.

8. The carburetor of claim 7 wherein the first opening of the tube is oriented so that fuel flows out of the first opening at an acute angle relative to the path of movement of the needle.

9. The carburetor of claim 6 wherein the second opening in the tube communicates with the air intake passage and wherein fuel enters the tube through the first opening of the tube and exits the tube through said second opening.

10. The carburetor of claim 1 which also comprises a second air passage in the body, and wherein the tube communicates with the second air passage to provide fuel into the second air passage so that air from the intake passage and fuel and air from the second air passage are provided to the engine.

11. The carburetor of claim 10 wherein the second air passage extends parallel to the air intake passage.

12. The carburetor of claim 10 wherein the second air passage is separate from the air intake passage.

13. The carburetor of claim 6 wherein the needle is adjustably carried by the follower.

14. The carburetor of claim 13 wherein the needle is threaded in the follower for axial adjustment of the position of the needle relative to the follower.

15. The carburetor of claim 5 wherein the follower is yieldably biased into engagement with the cam surface.

16. The carburetor of claim 4 wherein the first valve has a lever to facilitate moving the first valve and the cam surface is formed on the lever.

17. The carburetor of claim 5 wherein the first valve has a valve shaft and a valve head carried by the valve shaft, and the follower has a pair of fingers defining a gap between them in which the valve shaft is received to guide the follower for axial movement parallel to the valve shaft.

18. The carburetor of claim 10 comprising:

a bore of the body communicating with the fuel passage;

the tube fitted sealably in the bore and the tube having a center axis and a needle of the second valve disposed slidably in the tube for adjustably obstructing fuel flowing through the first opening.

19. The carburetor set forth in claim 18 wherein the bore and the tube traverse the air intake passage and air flows laterally, externally, around at least a portion of the tube.

20. The carburetor of claim 19 wherein the first opening is located in the second air passage, and the second opening communicates directly with the fuel passage.

21. The carburetor of claim 20 wherein the first opening extends generally radially through a wall of the tube, is flared outwardly from an inner surface of the tube to an outer surface of the tube, and has a sharp inner edge defined by the inner surface.

22. A carburetor that provides a fuel and air mixture to an engine, comprising:

a body having an air intake passage and a fuel passage in communication with a fuel source;

a fuel nozzle in communication with the fuel passage and having a tubular wall with a first opening through which fuel for the fuel and air mixture flows, the first opening having an elongated and concave first face extending between inner and outer edges of the tubular wall and an opposed elongated and concave second face extending between inner and outer edges of the tubular wall and the concave faces diverge away from one another in a radially outward direction so that the flow area of the first opening defined at least in part by the concave faces increases in the radially outward direction;

a first valve having a valve shaft and a valve head carried by the valve shaft in communication with the air intake passage, the first valve is movable between a first position corresponding to idle engine operation and a second position corresponding to wide open throttle engine operation;

a second valve disposed in communication with the fuel nozzle and movable between first and second positions to vary the effective flow area of the fuel nozzle first opening, wherein the first valve controls at least in part the air flow out of the carburetor and the second valve controls at least in part the fuel flow out of the carburetor; and a cam assembly operably associated with the first and second valves to move one of the first and second valves between its first and second positions in response to movement of the other of the first and second valves between its first and second positions.

23. The carburetor of claim 22 wherein the first valve has a valve shaft and a valve head rotatably carried by the valve shaft in the air intake passage to vary the air flow rate through the air intake passage as the first valve moves between its first and second positions.

24. The carburetor of claim 22 wherein the cam assembly comprises a cam surface associated with the first valve and a follower associated with the second valve, whereby the follower is responsive to movement of the cam surface to cause movement of the second valve.

25. The carburetor of claim 22 which also comprises a second air passage in the body, and wherein the fuel nozzle communicates with the second air passage to provide fuel into the second air passage so that air from the intake passage and fuel and air from the second air passage are provided to the engine.

26. The carburetor of claim 25 wherein the second air passage is separate from the air intake passage and does not directly communicate with the air intake passage within the carburetor body.

27. The carburetor of claim 25 wherein the second valve is carried by the body spaced from the air intake passage.

28. The carburetor of claim 22 further comprising:

a bore of the body communicating with the fuel passage;

a tube fitted sealably in the bore, the tube having a center axis, the tubular wall, the first opening, and a second opening spaced axially away from the first opening for flowing fuel into the tube; and a needle of the second valve disposed slidably in the tube for adjustably obstructing fuel flowing through the first opening.

29. The carburetor of claim 28 wherein the first opening is elongated axially with respect to the tube.

30. The carburetor of claim 29 wherein the tube has an open end which defines the second opening.

31. The carburetor of claim 29 comprising:

the first opening being a slit communicating through a wall of the tube;

the wall of the tube having an inner surface carrying a continuous inner edge defining in part the slit, and an outer surface carrying a continuous outer edge defining in part the slit; and the continuous outer edge defining a fuel flow cross section which is larger than a fuel flow cross section of the continuous inner edge.

32. A carburetor that provides a fuel and air mixture to an engine, comprising:

a body having an air intake passage, a fuel passage in communication with a fuel source and a bore of the body communicating with the fuel passage;

a first valve having a valve shaft and a valve head disposed in communication with the air intake passage and movable between a first position corresponding to idle engine operation and a second position corresponding to wide open throttle engine operation;

a tube fitted sealably in the bore, the tube having a center axis, a first opening through a wall of the tube and elongated axially relative to the tube for flowing fuel out of the tube, and a second opening spaced axially away from the first opening for flowing fuel into the tube;

a second valve disposed in communication with the fuel passage and having a needle disposed slidably in the tube for adjustably obstructing fuel flowing through the first opening and movable between first and second positions to vary the flow rate of fuel discharged from the first opening, whereby the first valve controls at least in part the air flow out of the carburetor and the second valve controls at least in part the fuel flow out of the carburetor;

an actuator associated with the first valve and the second valve to cause movement of one of the first valve and second valve in response to movement of the other of the first valve and second valve;

the wall of the tube having an inner surface carrying a continuous inner edge defining in part the first opening, and an outer surface carrying a continuous outer edge defining in part the first opening and the continuous outer edge defining a fuel flow cross section which is larger than the fuel flow cross section of the continuous inner edge; and the tube includes an elongated concave first face that extends between the inner and outer edges and defines in part the first opening, and an opposite elongated concave second face that extends between the inner and outer edges and defines in part the first opening.

33. The carburetor set forth in claim 32 wherein the first and second faces converge at spaced apart ends to form a valley at each end that generally is open radially outward with respect to the tube.

34. The carburetor set forth in claim 32 wherein the inner edge is sharp having an acute angle measured between respective first and second faces and the inner surface and through the wall.

35. A carburetor that provides a fuel and air mixture to an engine, comprising:

a body having an air passage and a fuel passage in communication with a fuel source;

a valve for fuel disposed in communication with the fuel passage and being adjustable to vary the flow rate of fuel discharged from the fuel passage and to the air passage and to control at least in part the fuel flow out of the carburetor;

a tube with a wall having a first radial inner surface generally facing at least in part upstream with respect to the fuel passage and an opposite second radial outer surface;

an opening communicating through the wall from a first continuous edge defined by the first surface to a second continuous edge defined by the second surface, an open end spaced axially from the opening, and the inner surface of the tube communicates the open end with the opening to permit fuel flow from the open end to the opening;

the first continuous edge being located upstream of the second continuous edge with respect to the fuel passage and having a smaller flow area than the second continuous edge; the first continuous edge being sharp and having an acute angle measured through the wall and to the first surface to atomize the fuel flow entering the opening;

a needle constructed and arranged to move axially in the tube to adjustably obstruct fuel flow through the opening by reducing the flow area of the opening; and the opening flares outward from the first continuous edge to the second continuous edge in a range of forty-five to sixty-five degrees.

36. The carburetor of claim 35 wherein the opening is elongated axially with respect to the tube.

37. The carburetor of claim 36 comprising:

an elongated first face defining in part the opening and extending between the inner and outer edges;

an elongated second face defining in part the opening and extending between the inner and outer edges; and a mid point of the opening which lies within an imaginary plane disposed perpendicular to a center axis of the tube, and wherein imaginary first and second cutting lines which lie in the imaginary plane also lie upon the first and second faces and intersect one-another at about the center axis.

38. The carburetor of claim 37 wherein the first and second faces are concave.

39. A carburetor for providing a fuel and air mixture to an engine, comprising:

a body having an air intake passage and a fuel passage constructed for communication with a fuel source;

a first valve communicating with the air intake passage and movable between a first position corresponding to idle engine operation and a second position corresponding to wide open throttle engine operation;

a tube having a wall with a first opening through the wall to the exterior of the tube and a second opening axially spaced from the first opening and communicating with the fuel passage for fuel flow through the tube between the openings and the openings, the first opening having generally opposed and axially elongate and concave first and second faces extending between inner and outer edges of the wall, and the flow area of the first opening defined at least in part by the concave faces increases in a radially outward direction;

a second valve communicating with the fuel passage and movable between first and second positions to vary the flow rate of fuel through the first opening of the tube to control at least in part fuel flow out of the carburetor; and an actuator associated with the first valve and the second valve to cause movement of one of the valves in response to movement of the other of the valves, whereby in operation the rate of fuel flow out of the carburetor varies with the rate of air flow through the air intake passage.

* * * * *

UNITED STATES PATENT AND TRADEMARK OFFICE

CERTIFICATE OF CORRECTION

PATENT NO. : 7,287,742 B2
APPLICATION NO. : 11/027816
DATED : October 30, 2007
INVENTOR(S) : Michael P. Burns It is certified that error appears in the above-identified patent and that said Letters Patent is hereby corrected as shown below:

Column 14
Line 25, delete "the openings and".

Signed and Sealed this

First Day of April, 2008

JON W. DUDAS
*Director of the United States Patent and Trademark Office*